United States Patent [19]

Platonov et al.

[11] 4,057,098

[45] Nov. 8, 1977

[54] METHOD OF PRODUCING THIN-WALLED CASTINGS

[76] Inventors: Boris Pavlovich Platonov, ulitsa Komsomolskaya, 11, kv. 4; Anton Abramovich Ryzhikov, Naberezhnaya Zhdanova, 80, kv. 28; Jury Borisovich Platonov, ulitsa Dyakonova, 8, kv. 40, all of Gorky, U.S.S.R.

[21] Appl. No.: 697,717

[22] Filed: June 21, 1976

Related U.S. Application Data

[63] Continuation of Ser. No. 593,521, July 7, 1975, abandoned, which is a continuation of Ser. No. 506,836, Sept. 17, 1974, abandoned, which is a continuation of Ser. No. 359,887, May 14, 1973, abandoned.

[51] Int. Cl.[2] ..... B22D 15/02; B22D 27/04

[52] U.S. Cl. ..... 164/125; 164/122; 75/123 CB

[58] Field of Search ..... 75/123 CB; 164/122, 164/125

[56] References Cited

U.S. PATENT DOCUMENTS 3,726,670 4/1973 Kusoka ..... 75/123 CB X

OTHER PUBLICATIONS

P. R. Beeley, *Foundry Technology*, Holsted Press Division, John Wiley & Sons, Inc., New York, 1972, p. 330.

"Production of Ductile Iron Castings", by J. W. Curry, pp. 373–375 in ASM Metals Handbook, 8th Edition, vol. 5, Forging & Casting, 1970.

*Gray and Ductile Iron Castings Handbook*, 1971, Chapter 3, "Metallurgy of Cast Iron", pp. 93–127.

*Primary Examiner*—Ronald J. Shore

*Attorney, Agent, or Firm*—Holman & Stern

[57] ABSTRACT

A method of producing castings comprising the steps of: pouring moulds with inoculated cast iron containing, by weight per cent: carbon 3.6–3.8, silicon 2.8–3.2, manganese up to 0.4, magnesium not more than 0.01, at a melt temperature ranging from 1420° to 1450° C, and subsequently cooling the cast iron. The thickness of walls of the castings is chosen so that the initial cooling rate is 10°–14° C/sec with a preset heat conductivity.

1 Claim, 4 Drawing Figures

METHOD OF PRODUCING THIN-WALLED CASTINGS

This is a continuation of application Ser. No. 593,521 filed July 7, 1975 which in turn is a continuation of Ser. No. 506,836 of Sept. 17, 1974, which in turn is a continuation of Ser. No. 359,887 filed May 14, 1973, all of which are now abandoned.

BACKGROUND OF THE INVENTION

The present invention relates to foundry practice and, more particularly, to methods of producing thin-walled castings.

Widely known is a method of producing castings from high-strength cast iron with nodular graphite by pouring inoculated cast iron into moulds and subsequently cooling the cast iron.

However, the high susceptibility of cast iron with nodular graphite to shrinkage defects (shrinkage holes and pores) necessitates the use of shrinkage heads which results in serious technological problems and is actually impractical for intricate castings of the cylinder-block type.

Moreover, for producing castings by the above-described method cast iron with a large content of expensive magnesium (at least 0.025%) must be used.

SUMMARY OF THE INVENTION

The object of the present invention is to provide a method of producing thin-walled castings from high-strength cast iron which ensures, the production of more light-weight (by 25–40%) castings and a lower consumption of materials required for their production.

Another object of the invention is the production of dense castings free from shrinkage holes and pores without using shrinkage heads, and featuring high mechanical properties.

These and other objects are accomplished by the provision of a method of producing thin-walled castings by pouring inoculated cast iron moulds and subsequently cooling the cast iron. in which method, according to the invention, the mould is poured with inoculated cast iron containing, by weight percent: carbon 3.6–3.8, silicon 2.8–3.2, manganese up to 0.4, magnesium not more than 0.01 with the melt temperature ranging from 1420 to 1450°C and wall thickness chosen so that the initial cooling rate is 10°–14°C/sec for a preset heat conductivity.

The herein-proposed method enables the production of intricate castings without using shrinkage heads, with thin, about 3 mm thick, walls made from high-strength magnesium cast iron with dense massive portions (without cavities) and rugged thin walls.

BRIEF DESCRIPTION OF THE DRAWINGS

The present invention will be better understood from a consideration of a detailed description of an exemplary embodiment thereof, when taken in conjunction with the accompanying drawings, wherein.

DETAILED DESCRIPTION OF PREFERRED EMBODIMENT

The herein-proposed method consists in the following:

Cast iron is melted by the known methods in melting units, its composition being brought up to the following weight percent: carbon 3.6–3.8, silicon 2.8–3.2, manganese up to 0.4 and phosphorus up to 0.08. This composition is characterized by a higher content of carbon and silicon. Then the cast iron is inoculated either by dopants in a ladle or by magnesium in an autoclave. Peculiar to the inoculation process is the use of a spheroidizing modificator in reduced doses so that the contents of residual magnesium in the castings is not more than 0.01% by weight with the sulphur contents amounting up to 0.002% by weight. Usually for producing cast iron with nodular graphite the contents of residual magnesium is assumed to be not less than 0.025% by weight with the above-specified sulphur contents. To prevent chilling, the spheroidizing modificator is introduced into the pouring ladle, and the moulds, for example, of an engine cylinder block with walls $3 \pm 0.3$ mm thick are poured at a temperature of 1430°–1450° C. As a rule, the minimum wall thickness of the automobile cylinder blocks amounts to 5–6 mm.

For obtaining castings with excellent mechanical properties and lower weight, it is necessary to have thin walls (which determine the strength of the castings) made from cast iron with nodular graphite. The thick parts of the castings, which are usually subject to machining and serve for fastening other elements to the castings, are made from cast iron with flake graphite. This will eliminate the formation of shrinkage holes and enhance the machinability of the castings as compared with those having nodular grapite throughout their sections.

It is common knowledge that high cooling rates contribute to the formation of nodular graphite. Therefore with a reduction in the wall thickness (from 5–6 mm to 3 mm) the process of heat transfer is carried out at a higher rate with an ensuing increase in the cooling rate. The formation of nodular graphite requires high cooling rates during the first two minutes, insofar as on completion of the process of spheroidization of the cast iron the rate of cooling of the castings does not affect the structural state of graphite.

The initial rate of cooling of the casting walls, 3 mm thick, therefore amounts to 10°–14° C/sec and that of the thick portions is equal to 1–4°C/sec.

Figure 1:
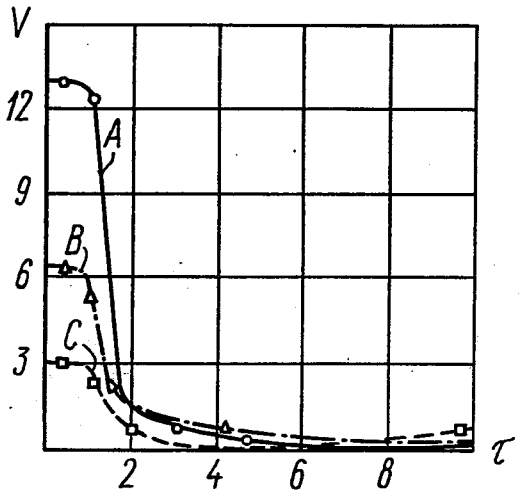
FIG. 1 is a graph illustrating the rate of cooling of a casting, according to the invention.

FIG. 1 shows cooling rate curves for the walls of different thickness. Plotted against the horizontal axis is time $\upsilon$ in minutes.

Plotted against the vertical axis is the rate of cooling (°C/sec) of the walls of various thicknesses. Curve A gives the cooling rate for a wall 3 mm thick, curve B for a 10-mm thick wall and curve C for a wall 40 mm thick. A comparison of these curves shows that maximum difference in the wall cooling rates is clearly manifest during the first 2 minutes, i.e. at the moment when the structural state of graphite is formed in both the thin and thick walls of the casting.

Subsequently the cooling rate curves converge abruptly, the difference between them being negligibly small, and reach the rate of cooling amounting to 0.5°–2.0° C/sec. With low magnesium contents in the cast iron a high cooling rate will contribute to the formation of nodular graphite in thin walls, and with a considerably lower cooling rate, gray cast iron with flake graphite will form in the thick walls. As a result, the thin walls of the casting will have the structure of high-strength inoculated cast iron and the thick walls that of gray cast iron which excludes shrinkage appearance of shrinkage defects in massive units of the casting without using the heads. The material of the thin walls of such a casting features excellent mechanical properties which ensures high strength and rigidity of the part with the wall thickness of up to 3 mm instead of 5–6 mm usually employed.

Figure 2:
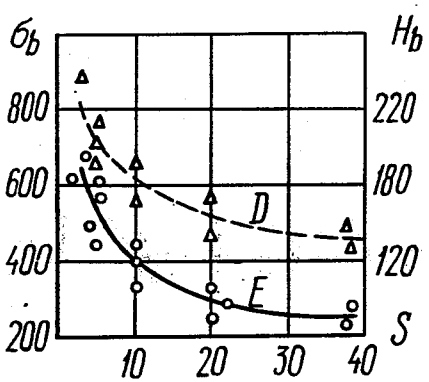
FIG. 2 shows the dependence of mechanical properties on wall thickness of the casting.

Referring to FIG. 2, a graph showing the dependence of the resistance to rupture and hardness on the wall thickness of the casting is depicted. Plotted against the X-axis is the wall thickness of the casting in mm. The left-hand vertical axis shows the resistance to rupture in $MH/m^2$ and the right-hand vertical axis shows hardness $H_b$. Curve D shows the dependence of hardness on the wall thickness and curve E is a strength-wall thickness curve.

Figure 3:
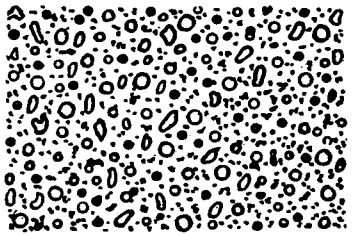
FIG. 3 shows the structure of thin walls of the casting produced according to the invention.

FIG. 3 shows the microstructure of cast iron with nodular graphite in 3 mm thick walls of the casting.

Figure 4:
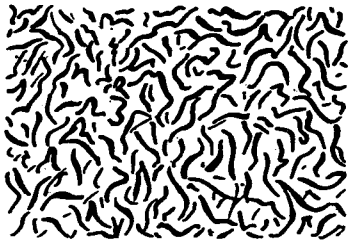
FIG. 4 illustrates the structure of thick walls of the casting produced according to the invention.

Shown in FIG. 4 is a microstructure of cast iron with flake graphite in the thick walls of the casting.

Hence, the herein-proposed method enables a 20–40% reduction in weight of the castings due to reduction in the wall thickness of 3 mm so as to eliminates shrinkage holes and pores without using shrinkage heads. It also enables the consumption of the spheroidizing modificator to be decreased and the machinability of the castings to be enhanced as compared to those of the castings in high-strength cast iron with nodular graphite produced by the prior-art methods.

We claim:

1. A method of producing castings having thin walls and thick walls comprising the steps of: pouring inoculated cast iron consisting essentially of, by weight, 3.6–3.8% carbon, 2.8–3.2% silicon, up to 0.4% manganese, not more than 0.01% magnesium and the remainder being iron at a melt temperature within the range of from 1420° to 1450° C into moulds; and subsequently cooling portions of the cast iron with thin walls of the castings being up to 3 mm that the initial cooling rate is 10°–14° C/sec to form nodular cast iron in the thin-walled portions and simultaneously cooling portions of the cast iron with thick walls of the castings of a thickness that the initial cooling rate is 1°–4° C/sec to form gray cast iron in the thick-walled portions.

* * * * *